United States Patent [19]

Conway et al.

[11] 3,960,652

[45] *June 1, 1976

[54] PROCESS OF FORMING WET LAID TUFTED NONWOVEN FIBROUS WEB AND TUFTED PRODUCT

[75] Inventors: Bernard W. Conway, Holyoke, Mass.; James Moran, Simsbury, Conn.

[73] Assignee: The Dexter Corporation, Windsor Locks, Conn.

[ * ] Notice: The portion of the term of this patent subsequent to Sept. 10, 1991, has been disclaimed.

[22] Filed: July 17, 1974

[21] Appl. No.: 489,411

Related U.S. Application Data

[63] Continuation-in-part of Ser. No. 341,699, March 15, 1973, Pat. No. 3,834,983.

[52] U.S. Cl. ..... 162/108; 162/115; 162/116; 162/146; 162/157 R; 162/157 C; 162/158; 162/168 R; 162/203; 162/207; 162/208; 264/121; 428/85

[51] Int. Cl.[2] ..... D21H 5/02; D21H 5/26

[58] Field of Search ..... 162/157 C, 157 R, 146, 162/203, 208, 211, 227, 103, 108, 114, 115, 116, 297, 302, 307, 308, 369, 370, 396, 399; 161/62; 264/121; 428/85

[56] References Cited

UNITED STATES PATENTS

| | | | |
|---|---|---|---|
| 2,730,933 | 1/1956 | Reynolds | 162/307 |
| 3,322,617 | 5/1967 | Osborne | 162/296 |
| 3,350,260 | 10/1967 | Johnson | 162/116 |
| 3,485,706 | 12/1969 | Evans | 162/115 |
| 3,720,578 | 3/1975 | Heling et al. | 162/302 |
| 3,834,983 | 9/1974 | Conway et al. | 162/157 C |

FOREIGN PATENTS OR APPLICATIONS

| | | | |
|---|---|---|---|
| 475,819 | 11/1937 | United Kingdom | 162/109 |

*Primary Examiner*—S. Leon Bashore
*Assistant Examiner*—William F. Smith
*Attorney, Agent, or Firm*—Prutzman, Hayes, Kalb & Chilton

[57] ABSTRACT

A tufted nonwoven web material exhibiting high loft, bulk and absorbency is made by a papermaking technique using an apertured, plate-like, fiber-collecting element having a structure appropriate to preventing entanglement between adjacent tufts prior to removal from the element. The apertured element is adapted not only to form the tufted nonwoven fibrous web but also to permit consolidation of individual tufts and facilitate the formation of tufted webs from 100 percent wood pulp. Additionally, webs having tufts on both planar surfaces also can be formed by this technique.

20 Claims, 5 Drawing Figures

PROCESS OF FORMING WET LAID TUFTED NONWOVEN FIBROUS WEB AND TUFTED PRODUCT

RELATED APPLICATION

This is a continuation-in-part of our copending application, Ser. No. 341,699, filed Mar. 15, 1973 now U.S. Pat. No. 3,834,983 and entitled "Process of Forming Wet Laid Tufted Nonwoven Fibrous Web and Tufted Product."

BACKGROUND AND SUMMARY OF THE INVENTION

The present invention relates generally to the production of tufted nonwoven fibrous web materials. More particularly, it is concerned with new and improved papermaking techniques for the production of tufted nonwoven materials and with such materials exhibiting the appearance and characteristics of high loft absorbent bath toweling and the like.

As is well known, conventional wet paper-making techniques have traditionally produced compact, closely formed sheets exhibiting the rattle and smooth surface characteristic usually associated with paper. In recent years, increased emphasis has been placed on the production of nonwoven fabrics for apparel, household and industrial uses. Such fabrics, though initially produced as dry fibrous batts processed on textile carding equipment, now include certain wet-laid webs made on paper-making machines using techniques especially developed for the production of nonwoven materials. The materials thus produced exhibit textile-like characteristics including softness, drape and hand, and have found extensive use in the field of disposable fabrics.

Many of the nonwoven fabrics produced heretofore have utilized a patterned configuration of one form or another in order to impart to the material the desirable characteristics of woven cloth. This patterned configuration has generally been achieved by subjecting a preformed web to controlled destructive forces which rearrange and reorient the fiber construction and provide a multitude of small apertures which improve the drape characteristics of the resultant nonwoven material. Typical examples of this fiber rearranging technique can be found in U.S. Pat. Nos. 2,862,251; 3,042,576 and 3,081,515.

Another technique for imparting some of the characteristics of woven fabrics to nonwoven fibrous materials is the use of a needle punch operation that forms "pegs" of fibers which increase the structural integrity of the web while improving the flexibility and hand thereof. Still other techniques involve light surface brushing to provide a raised nappy surface exhibiting improved softness, as for example in U.S. Pat. No. 3,101,520, or the use of electrostatic fiber flocking to achieve a comparable nappy surface. A further technique involves the utilization of a crepe or loop-forming operation either alone or in combination with a needle punch. The nonwoven fabrics containing the looped fibers tend to imitate the looped configuration characteristics of woven terry cloth and reportedly exhibit improved softness and high loft.

In substantially all of the foregoing processes it is necessary to first form a web and then subject it to an additional structure altering treatment to provide the desired characteristics. Additionally, in many instances the initial nonwoven web materials are not produced in accordance with the more economical web paper-making technique, thereby further adding to the cost of the finished product. Some progress has been made in producing patterned webs using a wet paper-making process and mention can be made to the dual wire technique disclosed in U.S. Pat. No. 3,322,617 and the techniques found in U.S. Pat. No. 2,940,891.

Despite these previous attempts, it was found that wet paper-making techniques had not been used successfully to produce tufted nonwoven toweling products having the loft, softness, bulk, absorbency and drape characteristics of turkish toweling. A key factor in the inability of the prior art techniques to produce such materials has been the inability of the wet process to provide high loft materials having a high concentration of absorbent relatively loose and flexible yet sturdy fibers extending outwardly from the main body of the web. However, a major step in that direction is described in our copending application Ser. No. 341,699 filed on Mar. 15, 1973 and entitled "Process of Forming Wet Laid Tufted Nonwoven Fibrous Web From a Viscous Fibrous Dispersion and Product". Described therein is a technique that provides tuft formation as the web is being formed. This is achieved using a viscous dispersing medium for the fibers and a coarse web forming wire screen. Although good tuft formation is obtained when using a screen of the type described, some entanglement of the free ends of the tufts prior to removal of the web from the screen has been experienced. Such entanglement not only adversely affects the appearance of the product but also causes difficulty in removing the web from the web forming wire.

Accordingly, it is an object of the present invention to provide an improvement in the process and product described in our aforementioned copending application and more specifically to provide an improved wet paper-making technique for producing high loft, tufty or tufted nonwoven fibrous web materials exhibiting the softness, drape, hand, feel, bulk and absorbency associated with woven looped materials such as turkish or terry toweling. Included in this object is the provision for a new and improved water-laid material exhibiting these characteristics.

Another object of the present invention is to provide a new and improved wet paper-making technique and resultant product which uniquely combines the advantageous features of the wet paper-making technology in a new and controlled manner to provide a product characterized by having on at least one surface thereof a multiplicity of fiber tufts or bundles extending outwardly from the continuous planar body portion of the product in the form of multiple strand fiber bundles exhibiting an appearance either similar to a weft of hair or a serried or consolidated fiber cluster similar to a French knot.

A further object of apertured present invention is to provide a technique of the type described utilizing a fiber suspending medium of varied viscosities and a thicker fiber collecting paper forming element that obviates entanglement between the tufts during the web forming operation. Included in this object is the provision for a technique capable of using a relatively thick aperturedd web forming element that assists in tuft formation, holds the individual tufts in spaced relationship and facilitates consolidation of the fibers within individual tufts.

Still another object of the present invention is to provide a technique and product of the type described wherein tufts are simultaneously formed on both sides of the web material during web formation.

Other objects will be in part obvious and in part pointed out in more detail hereinafter.

These and related objects are accomplished in accordance with the present invention by providing a fibrous nonwoven water-laid web material exhibiting high loft, bulk and absorbency. The web is comprised of a substantially planar web body portion of randomly arranged water dispersable fibers and a multitude of separate, spaced fiber tufts of high concentration arrayed on at least one surface thereof. The tufts are composed of a plurality of closely associated, relatively independent, substantially aligned fibers anchored within but extending from the web body portion in the form of fiber bundles exhibiting either a weft-like collapsed funnel appearance or a consolidated or serried configuration. The nonwoven web material is produced by a wet paper-making process that has been modified to include the steps of providing an aqueous fiber-dispersing medium having a controlled fluid viscosity and an apertured fiber collecting element having a plate-like structure that prevents fiber entanglement between adjacent tufts and disruptive adherence to the underside of the element. The apertured element is adapted not only to form the tufted nonwoven fibrous web with the tufts formed by bundles of closely associated individual fibers extending into the apertures but also to sufficiently isolate and control individual tufts to prevent interentanglement therebetween prior to removal from the web forming element.

A better understanding of the objects, advantages, features, properties and relationships of the invention will be obtained from the following detailed description and accompanying drawings which set forth an illustrative embodiment and are indicative of the way in which the principles of the invention are employed.

DESCRIPTION OF A PREFERRED EMBODIMENT

As mentioned, the new and improved tufted nonwoven web materials of the present invention are produced in accordance with a paper-making operation similar to that disclosed in our aforementioned application Ser. No. 341,699 and the disclosure therein is incorporated herein by reference. Use of this technique results in a nonwoven material having a high concentration of separate fiber bundles that may take the form of serried tufts located on at least one and preferably both planar surfaces of the web material. Such a tufted material perhaps can be better visualized by first appreciating the structural configuration of both woven toweling and nonwoven looped and nappy web materials.

Turkish or terry toweling is a loosely woven fabric characterized by a nap comprised of a large number of individual loops of thread projecting outwardly from the body of the fabric. These individual loops provide a pliable or yieldable cushion and readily bend or distort during use not only to give the soft feel of high bulk or loft, but also to expose greater thread surface area to the desired task of absorbing and wiping.

Nonwoven high loft materials of looped construction are somewhat similar to their woven counterpart but have a flexible adhesive base with fibers individually looped outwardly from the base and adhesively embedded in the base. The nonwoven fabric of this type can be formed by first producing striated base web substantially aligned fibers having a fiber length of about 2–3 inches. The web, produced by dry forming techniques, is then imprinted with a lattice-like pattern of adhesive and tensioned to retain the aligned fiber array. The adhesive is cured and the fibers in the web are looped by feeding the web to a gathering blade.

Heretofore improved softness has been imparted to textile fabrics by lightly brushing its surface to raise a fibrous nap or pile of individual fibers. This technique has also been applied to nonwoven web material but frequently has resulted in a substantial strength loss. It has been reported that suitable bonding will retain the strength of the material while permitting the brushed fibers to individually extend outwardly from the main body of the material to provide the desired softness.

Figure 1:
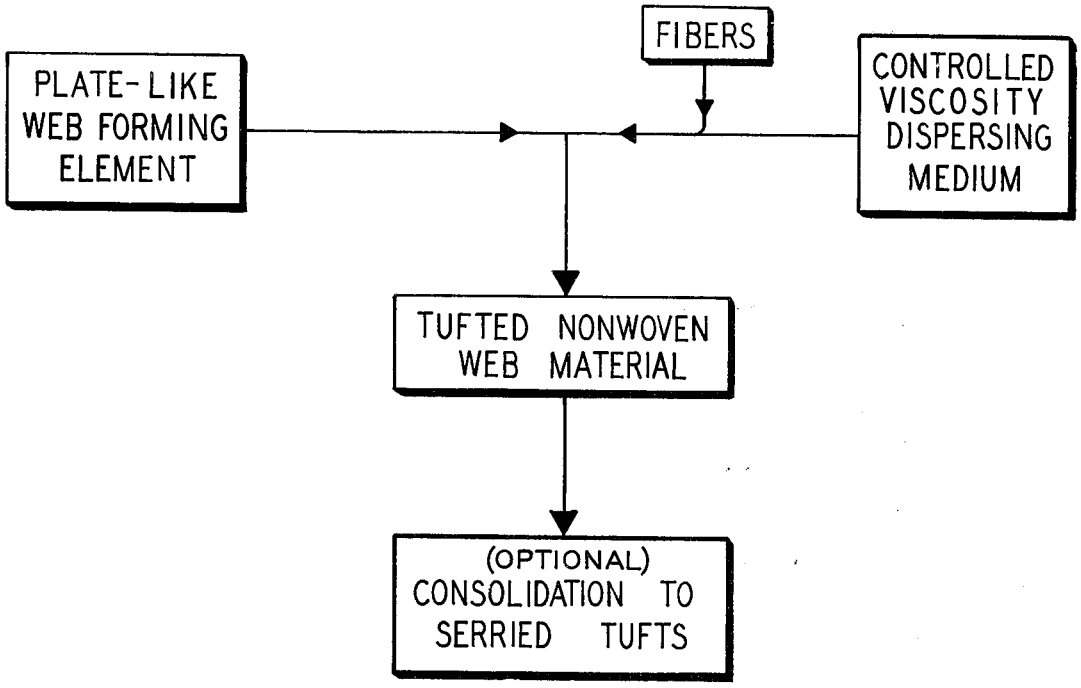
FIG. 1 is a flow diagram of the general steps employed in producing the new and improved web material of the present invention.
Figure 4:
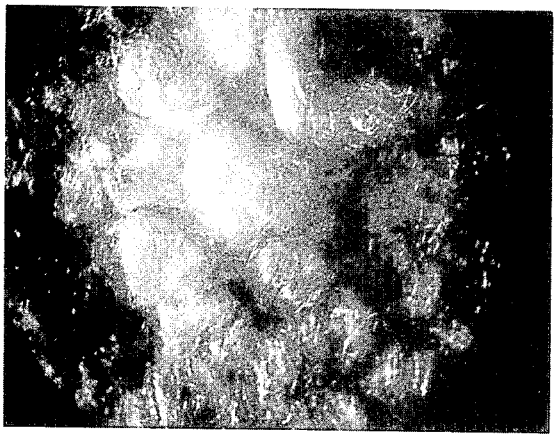
FIG. 4 is a photograph of the surface of the web material of the present invention at a magnification of 5x.

The tufted nonwoven high loft material of the present invention has neither a looped nor brushed or nappy surface, as formed. Instead, as shown in FIG. 4, it is characterized by a large number and high concentration of separate fiber bundles or tufts that extend outwardly from the main fibrous body portion of the web and cover the entire planar surfaces thereof. The multiple fibers in each tuft can terminate in free fiber ends initially spaced at randomly different distance from the main fibrous body. Despite the random location of the free fiber ends, the tufts as initially formed exhibit a somewhat tapered appearance much like a weft of hair in that they are firmly attached to the main body portion of the web and taper to their longest length near the center of the bundle or tuft. The long tufts, if not compacted, will tend to exhibit a waviness along their lengths and will loosely rest on the surface of the web material. Each tuft is composed of a plurality of closely collected or bundled fibers yet each fiber is substantially aligned and relatively independent of other fibers within the tuft. As a result the tufts exhibit substantial flexibility, pliability and softness. When still on the forming element the tufts exhibit a funnel-like configuration that tends to collapse or become obscure upon removal from the forming element. The tufts may be consolidated or serried during manufacture to yield a "puff" configuration that also imparts high loft, bulk and absorbency to the web material. Unlike "pegs" produced from needle punch operations the fibers within the tufts are not substantially ruptured or disrupted during tuft formation. Additionally, as will be understood from the following description, the number of fibers in each tuft and the concentration of the tufts will vary substantially depending on the operating conditions employed in producing the web material.

The fibers forming the tufts receive their projecting orientation during sheet formation by controlling a number of factors associated with the wet papermaking process. However, the principle factor involved in this technique is the production of suitable fluid dynamics within the system at the time the fibers are initially deposited on the fiber collecting structure and formed into the nonwoven web.

While all factors associated with the fluid dynamics of the system are not fully understood due to their complex interrelationships, it is believed that best results are achieved by laminar flow through the paper forming element under controlled fluid drainage conditions. The laminar flow apparently tends to orient the fibers into their initial substantially aligned positions perpendicular to the body of the web without at the same time causing the fibers to pass entirely through the collecting structure. In fact the fibers extending through the apertures of the forming element tend to collect against the side walls of each aperture and cling to the element thus promoting laminar flow near the center or axis of each aperture.

Two of the factors considered in our copending application as essential in achieving the optimum fluid flow conditions required for the tufted nonwoven product were (1) the use of a relatively coarse paper forming element and (2) a controlled fluid viscosity in the fiber dispersion used in forming the nonwoven material. However in accordance with the present invention it has been found that the type, and particularly the configuration and surface structure, of the web forming element is a major factor in effective tuft formation. As will be appreciated, other factors interrelated to the aforementioned will also affect the formation of the desired tufted nonwoven material. These include, inter alia, the consistency or fiber concentration of the dispersion, the vacuum used to effect removal of the dispersing medium, the type and composition of fibers employed as well as their denier and length and the basis weight of the resultant product. In fact, in accordance with the present invention it has been found that the use of an appropriate plate and shorter wood pulp fibers will permit the formation of tufted webs in a system that obviates the need for a viscous dispersing medium.

Thus one of the primary and necessary factors associated with the new and improved technique of the present invention is the utilization of fiber collecting or paper forming elements which are plate-like in character and, for some applications, thicker than those normally used in manufacturing light weight and intermediate weight papers. As is known, the standard Fourdrinier wire mesh screens conveniently employed in papermaking are typically woven fine wire members and have about 60–100 strands per inch in each direction with the strands having a thickness or diameter of about 0.006 inch. The screening elements described in detail in our aforementioned application Serial No. 341,699 were much coarser woven screens having a mesh size of about 45 mesh or less and preferably about 14 to 24 mesh. Although satisfactory tufting has been achieved with such screens, it was found that the tufts exhibited a tendency to adhere to the underside of the coarse screens and become interentangled with each other and with the coarse screen thereby hindering removal of the tufted web from the forming element. It is believed the curved bottom surfaces of the wires and the weave effect of those wires tended to foster the interentanglement.

In accordance with the present invention it has been found that the individual tufts can be maintained in relative isolation and separation prior to removal from the forming element by the use of a plate-like forming element as contrasted to an element that exhibits a woven effect and permits the wet clinging fibers to wrap around the underside of the element. As can be appreciated, the thickness of the plate will vary depending on factors such as the length of the fibers employed. Plates having a thickness from about 1/32 inch have given good results but plates having a thickness of about ¼ inch or more and preferably about ½ inch are preferred for most webs. The thicker forming element will tend to retain a major portion of the tufts within the individual apertures of the element and will facilitate consolidation of the tufts, if desired. Since only a minor portion, if any, of each tuft extends beyond the underside of such forming elements, there is a reduced tendency to resist removal of the web. As will be appreciated the exact type and size of the forming element utilized will also vary with the hole size and the desired product, as well as the type, denier and length of fiber used in the furnish, the consistency of the furnish and the viscosity of the suspending fluid.

Figure 2:
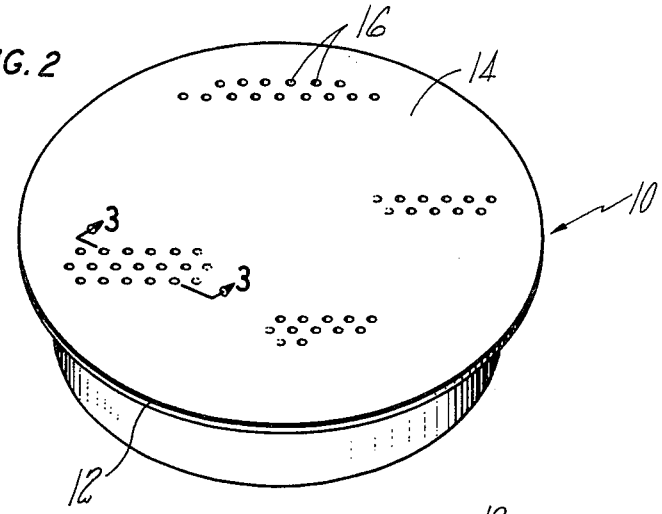
FIG. 2 is a perspective view of the web forming plate for a hand sheet mold used in accordance with the present invention.
Figure 3:
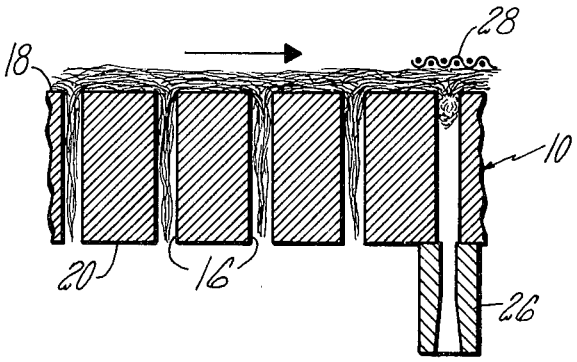
FIG. 3 is an enlarged sectional view of a web forming plate as might be taken along the line 3—3 of FIG. 2 and illustrating the tufted web thereon and a compacting jet and backing screen used in accordance with one aspect of the present invention.

Referring now to FIGS. 2 and 3, a web forming element 10 for a hand sheet mold is shown as one embodiment incorporating the features of the present invention. The element 10 is a relatively thick plate-like member having a peripheral rim 12 and a web forming control area 14 comprised of a multitude of tuft-forming apertures 16 extending fully through the plate 10 and arranged in a pattern of staggered rows with the distance between apertures being suited to the particular application. For example, a plate having a thickness of about ½ inch and a central area with a diameter of about 2¾ inches may conveniently accommodate 121 apertures per square inch wherein the apertures have a diameter of 1/16 inch. Such a plate will have an open area of 37.2 percent. The plate 10 exhibits substantially flat and smooth top and bottom surfaces 18 and 20, respectively, within the forming area 14.

It appears that the controlling factors for the plate involve the prevention of tuft entanglement coupled with the maintenance of laminar flow. Thus a thin plate that can provide a "tubular flow effect" through its apertures and at the same time obviate entanglement may be used. Included in this is the forming element's ability to provide an "orifice lip effect" at both the top and bottom surfaces. Thus the smooth top and bottom surfaces of the plate should provide relatively well defined orifice edges or lips at each aperture. A slight degree of curvature is permissable and, in such instances, the lip at the bottom surface appears more critical. The lip effect coupled with the tubular multiapertured configuration permits laminar flow of the dispersing fluid through the plate during web formation so as to drive the fibers into the orientation required for producing the desired tufted configuration. As the fibers flow into these apertures, they tend to cling to the side walls of the apertures forming a fiber funnel and promoting the tubular flow. Where the walls of the apertures do not meet the underside of the plate with a large radius curvature, there is less of a tendency to cling to the underside of the element and thus less likelihood of entanglement. The size of the openings in the plate must be controlled so that the fibers within the fiber dispersion will be retained during the web forming processes. Yet at the same time, the size of the solid areas should not be so great as to interfere with the drainage of the fiber dispersion. The precise aperture size and concentration must be such as to provide the required fluid flow during drainage while permitting the requisite fiber collection as the fiber dispersing medium passes rapidly through the apertured plate. Thus in one embodiment the apertures in a 0.5 inch thick plate had a diameter of about 0.063 inch and were arranged in staggered rows, as shown in FIG. 2, on 0.09 inch centers.

The web forming element may be a composite laminar structure but is perferably a plate having 25 and more apertures per square inch and perferably about 100 to 500 apertures per square inch. The apertures may be in a staggered array, as shown, or in other suitable configurations and will vary in size from about 1/32 to about 3/16 inches in diameter.

Generally, the size of the open area will relate to the diameter of the fibers in the dispersion since the thicker fibers form tufts more effectively on the more open plates. For most applications, an average open area between about 15 and 50 percent is preferred although the exact extent of open area as well as the thickness of the plate used can vary substantially depending on the numerous other considerations relating to the papermaking process, particularly the fiber size.

It is an advantage of the present invention that a nonwoven or woven scrim or gauze or a multitude of continuous filaments may be used in conjunction with the primary fiber collecting element. In that instance the scrim would travel with a supporting element, and the openings in the scrim would facilitate tuft formation while simultaneously embedding the scrim in the nonwoven fibrous web deposited thereon. Such an arrangement would substantially strengthen the web without undue sacrifice in the softness of the tufted material.

Another feature of the papermaking technique of the present invention involves the use of a dispersing fluid for the fibers that is of controlled viscosity ranging upwardly from that of water, i.e. 1 centipoise, depending on the plate and fibers used in the system. The high viscosity medium advantageously permits the utilization of numerous fibers and mixtures thereof, not heretofore used in a wet papermaking process, including mixtures of textile staple fibers with fibers having a substantially shorter length. The viscous solution used to disperse the fibers prevents the formation of fiber clumps within the dispersion and reduces the tendency of the dispersed fibers to entangle. Additionally, the dispersing medium maintains the fibers in their dispersed condition during drainage and assures a more uniform fiber distribution within the resultant web material thereby contributing to the improved softness, flexibility and drape characteristics of the material produced. As mentioned, the viscous medium substantially expands the number and type of fibers that can be used while the plate permits the use of, at present, aqueous dispersions wherein all of the fibers are very short hard wood fibers. This is believed due primarily to the orifice lip effect and laminar or tubular flow through the plates employed for the short fibers even in the absence of viscosity producing additives in the dispersing medium. Thus the present invention enables tuft formation even upon the utilization of 100 percent natural, or synthetic papermaking or textile staple fibers or appropriate mixtures thereof.

As a general rule, the dispersing medium should exhibit a viscosity greater than about three centipoises when using fibers longer than conventional wood pulp fibers. Although tufting can be achieved at low viscosity levels when other operating characteristics are appropriately controlled and where select fibers are employed, a viscosity of about 10 centipoises or more is preferred for the longer fibers. The viscosity actually utilized will vary for practical applications can be as low as one centipoise or as high as 250–300 centipoise. As will be appreciated, certain practical considerations will control the upper limit since extremely high viscosities may tend to interfere with the drainage characteristics of the system. Other practical limits relating to the runability of the papermaking machine include the vacuum available for removing the dispersing medium without disrupting the web, the concentration of the fibers in the medium, the extractability of the medium and the effect of its residual presence in the web as well as the economics associated with the system.

The viscosity controlling material may be a natural or synthetic material or blends thereof. However, the preferred viscosity controlling materials are the high molecular weight resins, such as the water soluble polymers formed from the polymerization of acrylamide. These polymers are preferably used since their dilute aqueous solutions can be easily controlled to provide the desired viscosity at the drainage area of the system. The preferred acrylamide polymer employed is a material sold by Dow Chemical Company under the trade name Separan AP-30. Other materials such as polyethylene oxide sold by Union Carbide Corporation under the name Polyox WSR 301 as well as selected viscosity producing carboxy methyl cellulose solutions can also be utilized. In addition, other conventionally employed material that will produce controlled viscosity in aqueous solutions include water soluble synthetic polymeric electrolytes of methacrylic acid and co-polymers thereof, as well as natural viscosity producing materials such as degradable systems, mixtures of natural and synthetic gums and inorganic salts. However, in accordance with the preferred embodiment of the invention, the viscosity controlling material should be one that can be added prior to web formation such as in the fiber dispersing equipment, headbox, etc., and will maintain its viscosity up to and through the drainage area of the system.

As mentioned, the particular type of web forming element used and the specific viscosity employed for the dispersing medium will depend on other interrelated factors such as the type, denier and length of the fibers employed in the fiber dispersion. One of the particularly advantageous features of the present invention is the fact that tufted webs can be produced from a wide variety of natural and synthetic papermaking and textile fibers. For example, synthetic or man-made papermaking or textile staple fibers such as rayon, nylon, polyesters or vinyl polymers or co-polymers can be used either alone or in combination with natural fibers such as bleached or unbleached Kraft, manila hemp, jute and similar papermaking fibers. Additionally, it is believed that inorganic fibers such as glass, quartz, ceramic, mineral wool, asbestos and similar materials may also be employed in accordance with the teachings of the present invention.

The synthetic fibers may vary in both denier and length although the lower denier fibers are generally preferred. Fibers from about 1 or 1.5 denier per filament (dpf) to about 15 dpf and more have been successfully used and have produced excellent results. However, with the higher denier material it is generally necessary to use a lower fiber concentration and a more viscous dispersing medium. As will be appreciated the minimum and maximum denier employed will depend on many other related factors including the product requirements, machine operating conditions, consistency, plate size, etc.

The length of the synthetic fibers employed depends to a large degree upon the particular forming element used and will range from about ⅛ of an inch or more up to several inches and can be of the straight cut-tow type used in papermaking operations or the crimped or straight textile staple fiber type. As mentioned, it is preferred to utilize the finer denier material having a length of about ½ to ¾ inch or more in order to impart to the material improved softness while retaining the desired loft and absorbency characteristics. However, mixtures using natural and synthetic papermaking fibers having lengths down to 1/16 inch or less may also be employed depending upon the particular properties and characteristics required in the final product.

In addition to the length and denier of the fibers employed, the fiber consistency or concentration in the dispersion prior to web formation requires appropriate control to facilitate formation of the tufted configuration. As a general rule, the lowest fiber concentration or consistency compatible with good release of the resulting product from the web forming element is most desirable for best tuft formation. Accordingly, a fiber concentration ranging from about 0.01% to about 1.0% can be used, with the preferred range being about 0.05% to 0.5% fiber concentration. In standard laboratory operations a fiber concentration of about 0.2% has been found to produce consistently good results. The consistency on large papermaking machines will, of course, vary with machine conditions.

The fiber concentration and the viscosity of the dispersant will also affect the degree of vacuum or suction that should be applied to the underside of the paper forming element during web formation in order to provide the desired tufted effect. Although good tufting can be obtained under appropriate conditions even in the absence of vacuum, it is generally preferred that a slight vacuum equivalent to about 0.5 inch of mercury be applied to the underside of the web forming wire as the fibers are deposited thereon in order to ensure the appropriate fluid dynamics of the system. In some instances, higher vaccums may be applied such as a vacuum equivalent to a few inches of mercury. However, these variations will depend not only on fiber concentration and the viscosity of the dispersing medium but also on other factors associated with these systems such as the surface smoothness of the forming element and the aperture size and lip configuration as well as the type and length of fiber utilized. Comparable effects may be obtained by applying pressure to the top surface of the web so long as the appropriate pressure differential is created across the web and plate.

An additional factor for consideration when using the technique of the present invention is the weight of the material being produced. The technique described herein is capable of producing a tufted product at weights as low as about ½ ounce per square yard. However, such light weight materials are only produced by very fine control over the other factors associated with the technique and the basis weight of most materials is at least one ounce per square yard or higher.

It can be appreciated the formation of the tufted configuration is initiated at the beginning of the web forming process and in fact it is believed that the tuft is the first portion of the web to be formed as the fibers are draped over the solid portion of the web forming plate and are drawn through the intermediate opening due to the fluid dynamics of the system. As the web gains thickness more fibers are deposited both in the funnel-like tufts or bundles and within the body of the web until it reaches its desired basis weight and strength. It should be noted that the funnel configuration of the tuft adds to its flexibility, pliability and softness due to a natural cushion effect.

As mentioned, it is a feature of the present invention that the tufts need not be of weft-like appearance but preferably may be serried so as to exhibit a ball-like clustered appearance similar to a French knot. Such webs have been found to exhibit up to 100% improvement in tensile strength. The "puffy" tufted surface is perhaps best shown in the photomicrograph of FIG. 4. In that figure the tufts are clearly shown as ball-like clusters which have an appearance of obvious softness, pliability, and resiliency.

One way of forming this serried tuft configuration is depicted in FIG. 3. In that technique the tufted web is treated prior to removal from the forming element with a fluid jet or similar consolidating force applied from the bottom of the forming element such as by nozzle 26. A backing wire, such as screen 28 can be placed over the top of the web to prevent undesirable displacement of the web from plate 10. As will be appreciated the consolidating force is applied to the tufts only since those portions of the web between the tufts are masked by the plate. The force may take the form of a high velocity flow of water or air in the form of a jet stream directed upwardly from below the forming element. The backing screen tends to hold the serried tuft within its individual forming chamber but at the top thereof so that the web can be easily removed from the apertured plate without snagging.

If desired the web may be subjected to additional post formation treatments prior to or after removal from the plate and either prior to or after being dried in a conventional manner. For example an adhesive may be applied to the tufts only or to the nontufted surface as a liquid or spray while the web is on the plate or subsequent to removal. Additionally the bonding may take the form of heat for heat activating binding fibers within the web.

Although the many factors mentioned hereinbefore are all interrelated in order to provide the desirable tufted configuration, it has been found that certain generalized guides can be stated. In this regard it has been found that best results are achieved when using a web forming element having a smooth surface with well defined apertures, the lowest fiber consistency compatible with good release from the web forming element and the lowest fiber denier acceptable in the product requirements. Additionally, it has been found that longer fibers not only produce longer tufts but also provide added cushioning and added strength within the consolidated tufts. Additionally, it has been found that lower denier fibers give a better tufted product than higher denier fibers regardless of the length of the fibers employed. In this connection and as mentioned hereinbefore, the higher denier fibers generally require a forming element having larger apertures and also require a higher viscosity and lower consistency than corresponding fibers of a finer denier. For example, a 1.5 dpf fiber will provide an acceptable tufted product at a viscosity of 12 cps and a fiber concentration of about 0.2%, whereas comparable results can only be obtained with a 15 dpf fiber at a viscosity of 150 cps and a consistency of 0.1%.

Figure 5:
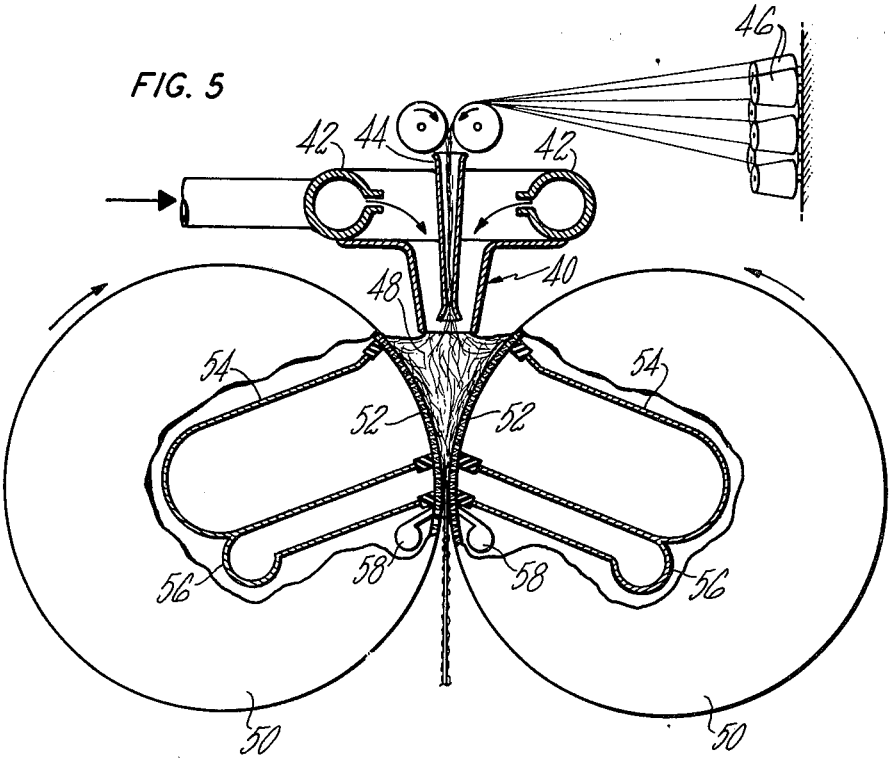
FIG. 5 is a schematic view of a machine incorporating the features of the present invention in producing a two-sided tufted web material.

The use of an apertured plate forming element also facilitates the production of tufted webs having tufts on both sides of the web material as well as other modifications. As shown in FIG. 5, a fiber dispersion may be supplied to a headbox 40 having a dual feed trough 42 and a secondary central feed chute 44 for supplying a scrim insert or a plurality of continuous filaments from an array of bobbins 46. The headbox 40 discharges the fibers and filaments to the nip area 48 between a pair of rotating drums 50 having apertured plate-like confronting surfaces 52 having a thickness of about 0.5 inch. The drums synchronously rotate in opposite directions as indicated by the arrows so that they move in unison through the nip area 48. As shown, a low vacuum suction box 54 can be used in each drum to assist in the fluid dynamics of the system. In this connection good results have been obtained using a low vacuum of about 0.5 inch of mercury. If desired a high vacuum box 56 may also be used in conjunction with the adjustably positionable boxes 54 to assist in removal of the dispersing medium. Also positioned within the interior of each drum adjacent the vacuum box 56 are fluid jet nozzles 58 for effecting consolidation of the tufts prior to being separated from the perforated surfaces of the drums.

In order that the present invention may be more readily understood, it will be further described with reference to the following specific examples which are given by way of illustration only and are not intended to be a limit on the practice of the invention:

EXAMPLE I

A tufted web was made on a hand sheet mold fitted with a perforated web forming plate having a thickness of about 0.5 inch. The plate was a circular disc substantially as depicted in FIGS. 2 and 3 with a flat smooth top surface having a diameter of 3⅞ inches with a solid periphery defining a perforated area having a diameter of 2¾ inches. The apertures within the perforated area were of 0.0625 inch diameter and extended fully through the plate perpendicular to the top surface. The apertures were arranged in staggered rows with each aperture spaced from its six closest adjacent apertures by a distance of 0.09 inch on centers resulting in about 121 apertures per square inch of web forming surface area.

A fiber dispersion was prepared from 1.5 denier per filament (dpf) rayon staple having a length of ⅜ inch in a 0.04% aqueous solution of a polyacrylamide (Separan AP-30) having a viscosity of about 12 cps. Sufficient fibers were added to provide a fiber concentration of 0.2 percent by weight.

Using a vacuum of 0.5 inch of mercury, a web was formed on the perforated plate from the fiber dispersion. The web exhibited good tufting and the tufts did not extend beyond the bottom of the plate permitting easy removal of the web from the plate. The web had a basis weight of 5 ounce/yard$^2$.

The foregoing procedure was repeated with good success when the fiber consistency was reduced to 0.1 percent and no vacuum was used during drainage. However, an increase in viscosity of 45 cps coupled with a vacuum of 3 inches of mercury resulted in most of the fibers being drawn through the plate with little or no web formation.

EXAMPLE II

The procedure of Example I was repeated except the fiber dispersion was prepared from 16 denier per filament (dpf) polyester staple having a length of ¾ inch in an aqueous solution (0.32%) of a polyacrylamide (Separan AP-30) having a viscosity of about 400 cps. The fiber concentration was 0.1 percent by weight. A vacuum of 7½ inches of mercury was used and the resulting web exhibited good tufting characteristics with no interentanglement between adjacent tufts even though the tufts extended below the plate. The web had a basis weight of 7.5 ounce/yard$^2$.

This procedure was repeated except the fiber dispersion was prepared from a blend consisting of 70% of the polyester staple and 30% of Weyerhauser SG Kraft wood pulp. The resultant web had a basis weight of 7.5 ounce/yard$^2$ and also exhibited good tufting characteristics.

EXAMPLE III

The procedure of Example I was repeated using the same web forming plate but the fiber dispersion was prepared from 1.5 dpf rayon staple having a length of ½ inch and the dispersing medium was a 0.27% aqueous solution of a polyacrylamide (Separan AP-30) having a viscosity of about 220 cps. The fiber concentration employed was 0.1 percent by weight.

Using a vacuum of 7½ inches of mercury, a web was formed at a basis weight of 10 ounce/yard$^2$ which produced a high degree of tufting and gave excellent loft, bulk and feel characteristics. The tufted web was somewhat superior to the web of Example I in that the tufts were more wholesome and better defined.

EXAMPLE IV

The procedure of EXAMPLE I was repeated but after removing the web from the forming element it was treated on the nontufted side with a 0.15% acrylic polymer latex solution by a spraying technique. The latex emulsion used was an amide cross-linked carboxylated ethyl acrylate sold by Union Carbide Co. under the name UCAR 874. After spraying the latex on the web, it was then dried and cured on a steam heated drum dryer at approximately 280°F. The amount of latex added to the web as a percentage of the dry fiber weight was about 5%. Since the fibers making up the tufts are rooted in the planar body or base of the web, the tufts become more firmly anchored while leaving the tufted portion both soft and pliable.

EXAMPLE V

The procedure of EXAMPLE I was repeated except the fiber concentration was maintained at 0.05% by weight and a vacuum of 1 inch of mercury was used. Six webs having a basis weight of about 6.5 ounce/yard$^2$ were produced in this manner, three of which underwent tuft consolidation by a reverse fluid flow treatment while still on the forming plate. Using a 0.023 inch diameter water jet with a pressure of 80 psig yielding a jet velocity of approximately 100 feet per second, water was directed against the underside of the web forming plate. Fifteen passes were made over each aperture and the web was easily removed from the plate and dried. A one inch wide strip was cut from each of the six webs and tested for strength on a Scott Tensile Tester, Model X5. The three untreated webs used as control sheets exhibited an average dry tensile strength of 148 grams/inch while the consolidated tufted webs gave an average dry tensile of 323 grams-/inch. As can be seen, the consolidation of the tufts resulted in a substantial improvement in tensile strength of the webs.

EXAMPLE VI

The procedure of Example V was repeated except the fiber concentration of the dispersion was 0.05 percent by weight and a vacuum of one inch of mercury was used in initially forming the webs. The consolidation of the tufts into ball-like clusters similar to French knots was achieved at a lower pressure, namely 40 psig, using a 0.015 inch fluid jet making 15 passes over each aperture. The 40 psig provided a jet velocity of approximately 50 to 60 feet per second.

EXAMPLE VII

A fiber dispersion was prepared from 100 percent Kraft wood fiber pulp in water at a fiber concentration of 0.13 percent by weight. The dispersion was fed to a handsheet mold fitted with the plate described in Example I. Using a vacuum of 5 inches of mercury a web having a basis weight of 4.5 ounce/yard$^2$ was produced exhibiting good tufting over its entire area.

The procedure was repeated except the plate was replaced with a plate having a thickness of 0.0312 inch and a staggered array of equally spaced apertures having a diameter of 0.125 inch. The apertures were on 0.188 inch centers. A tufted web was obtained but substantial fiber loss was experienced due to the aperture size and the size of the fibers.

EXAMPLE VIII

The procedure of Example I was repeated except the fiber dispersion was prepared from 50 percent of Weyerhauser W Kraft wood pulp and 50 percent of 1.5 dpf rayon having a length of 3/16 inch. The dispersing medium was a 0.11% aqueous solution of a polyacrylamide (Separan AP-30) having a viscosity of about 40 cp. The fiber concentration was 0.1 weight by weight. Using a vacuum of 7½ inches of mercury a fully tufted web was produced having a basis weight of 3.5 ounce/yard$^2$.

EXAMPLE IX

A web having tufts on both planar sides of the web material was formed using a pair of apertured plates positioned in vertically spaced substantially parallel ralationship so as to provide a narrow gap therebetween. The apertures in the plates were essentially the same as the apertures in the plate used in Example I. The two plates had a vertical extent of about 2 inches and were spaced to provide a gap of about 0.0625 inch at the bottom and about 0.094 inch at the top.

The dispersion was prepared from 1.5 dpf rayon staple having a fiber length of ½ inch in a 0.07 percent aqueous solution of a polyacrylamide (Separan AP-30) having a viscosity of about 23 cps. The fiber concentration was 0.1 percent by weight. The fiber dispersion is fed into the gap between the plates so that the viscous media is drawn through the plates leaving the fiber stapled across and extending into the apertures. A vacuum of 7½ inches of mercury was used on the outside of both plates and the resilient web exhibited good tufting but tended to delaminate.

The procedure was repeated using a fusible interliner to promote integration and structural integrity in the web. The plastic fusible interliner employed was a structure known as "Delnet" sold by Hercules Chemical Co. The resultant web was fused under heat and pressure resulting in full integration of the interliner without adversely affecting tuft definition or the high degree of bulk and softness provided by the tufts. The webs were fused at 350° Farenheit using a heated jaw under a pressure of 20 psig for a period of 6 seconds and exhibited a basis weight of 5 ounce/yard$^2$.

EXAMPLE X

The procedure of Example I was followed except the fiber dispersion was prepared from 1.5 dpf rayon staple having a length of ¾ inch in a 0.24 percent aqueous solution of a polyacrylamide (Separan AP-30) having a viscosity of about 175 cp. The fiber concentration was 0.1 percent by weight. A pressure differential across or through the web-forming plate was produced by applying air pressure to the top of the plate rather than vacuum to the bottom. The air pressure used was 3.7 pounds per square inch gauge pressure which is equivalent to 7½ inches of mercury vacuum. The resulting web exhibited good tufting over its entire surface.

As mentioned in our earlier application, tufted nonwoven web material is particularly well suited for use in the manufacture of various "disposable" items. These uses include not only wash cloths, wiping cloths, towels, cosmetic wipes, coverstock for diapers, sanitary napkins and the like, blankets, dish cloths, bandages, dressings and other medical supplies, barber's neck bands, heat rests, dust collector felts, dust cloths and mops and wiping cloths of all kinds but also wearing apparel such as disposable bathing suits and jackets, surgical masks, disposable cap and industrial and domestic clothing such as costumes and novelty clothing including interlining for clothing. It is anticipated that the tufted web material may also be advantageously employed for disposable bibs, tray covers, placemats, facial tissue, disposable draperies, carpet backing and semi-durable rugs, wall covering, insulating materials including cyrogenic insulation, obstetrical sheets, sleeping bag liners, bed pad liners and covers, protective wrapping or as substrates for a coating of a fabric softening composition. The web material might also be employed as a filter material for either air or fluid, such as coffee filters or infusion web materials such as tea bags, and if suitably treated could be used as a coating substrate for various items such as a substrate for synthetic leather or as a substitute for buckram interliners. As will be appreciated, laminated structures could also be formed from the nonwoven web material of the present invention including laminates for reinforced layers of plastic film, laminated or molded papers, light diffusers, lampshades or decorative sliding door paper or the material could be used in cordage, stretchable bags or sacks or for use in the upholstery for home furnishings and automobiles. The foregoing list of uses is not intended to be exhaustive but is merely exemplary of the versatility of the material produced in accordance with the present invention.

As will be apparent to persons skilled in the art, various modifications, adaptations and variations of the foregoing specific disclosure can be made without departing from the teachings of the present invention.

We claim:

1. A process from producing a tufted nonwoven waterlaid fibrous web material comprising the steps of providing a plate-like, fiber-collecting element having a smooth fiber collecting surface and a multitude of apertures extending from said surface continuously through said element, each of said apertures having a lip portion at said surface and a generally tubular configuration through said element, providing a dispersion of fibers suited for being dispersed in an aqueous medium at a fiber concentration of at least about 0.01 percent by weight and depositing the fibers from said dispersion on the fiber collecting element to promote laminar flow of the aqueous fiber dispersing medium through the tubular apertures in said plate-like element and thereby form a tufted nonwoven fibrous web material on said element, said web having integral tufts formed from bundles of closely associated individual fibers extending over said lip portion and into the apertures in said element but not more than a minor portion of said tufts extending beyond the bottom of said element thereby preventing entanglement of adjacent tufts.

2. The process of claim 1 wherein the fiber collecting element is provided with apertures of at least about 1/32 inch width in an array having a concentration of less than about 500 apertures per square inch.

3. The process of claim 1 wherein the plate-like fiber collecting element has a smooth underside forming abrupt lip portion at each aperture.

4. The process of claim 1 wherein the fiber dispersing medium has a viscosity of about 1 centipoise.

5. The process of claim 1 wherein the fiber dispersing medium has a viscosity greater than about 1 centipoise.

6. The nonwoven web material of claim 1 wherein the fibers within the web are selected from the group consisting of natural fibers, manmade fibers and mixtures thereof.

7. The process of claim 1 including the step of applying a differential pressure across the thickness of the plate with the higher pressure being on the side of the said smooth surface.

8. The process of claim 1 including the subsequent step of consolidating the tufts while positioned within the apertures to provided serried tufts on the surface of the web material.

9. The process of claim 8 wherein said consolidation includes the application of a fluid stream to the tufts in a direction opposite to the direction of laminar flow during tuft formation.

10. The process of claim 9 wherein said fluid stream includes a jet spray.

11. The process of claim 1 wherein a pair of said fiber collecting elements are brought into spaced confronting relationship and the fiber dispersion is fed therebetween to simultaneously deposit fibers on the confronting elements and thereby form a web material having tufts on opposite planar surfaces thereof.

12. The process of claim 11 including the incorporation of a reinforcing material into the interior of the web material.

13. The process of claim 11 including the consolidation of the tufts by applying a jet flow to the underside of the element while the tufts are in the apertures.

14. A product made by the process of claim 1.

15. A product made by the process of claim 4.

16. A product made by the process of claim 6.

17. A product made by the process of claim 11.

18. A product made by the process of claim 12.

19. A process for producing a tufted nonwoven fibrous web material comprising the steps of providing a plate-like, fiber-collecting element having a smooth fiber collecting surface and a multitude of apertures extending from said surface continuously through said element, each of said apertures having a lip portion at said surface and a generally tubular configuration through said element, providing a fluid dispersion of fibers and depositing the fibers from said dispersion on the fiber collecting element to promote laminar flow of the fluid fiber dispensing medium through the tubular apertures in said plate-like element and thereby form a tufted nonwoven fibrous web material on said element, said web having integral tufts formed from bundles of closely associated individual fibers extending over said lip portion and into the apertures in said element but not more than a minor portion of said tufts extending beyond the bottom of said element thereby preventing entanglement of adjacent tufts.

20. The process of claim 19 wherein the fiber dispersing medium is a fluid having a viscosity greater than about 1 centipoise.

* * * * *